US006354278B1

(12) United States Patent
Kawasaki

(10) Patent No.: US 6,354,278 B1
(45) Date of Patent: Mar. 12, 2002

(54) ENGINE OF OUTBOARD MOTOR

(75) Inventor: Naoki Kawasaki, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/537,309

(22) Filed: Mar. 29, 2000

(30) Foreign Application Priority Data

Mar. 29, 2000 (JP) ..... 11-90215

(51) Int. Cl.[7] ..... F02M 37/04
(52) U.S. Cl. ..... 123/509; 123/195 A
(58) Field of Search ..... 123/509, 508, 123/507, 195 A, 516, 495; 74/567

(56) References Cited

U.S. PATENT DOCUMENTS 5,501,202 A * 3/1996 Watanabe ..... 123/572
5,603,303 A * 2/1997 Okajima et al. ..... 123/508
5,605,077 A * 2/1997 Tsunoda et al. ..... 74/567
5,829,414 A * 11/1998 Tsunoda et al. ..... 123/508
6,082,336 A * 7/2000 Takahashi et al. ..... 123/508
6,148,787 A * 11/2000 Takano ..... 123/195 A

* cited by examiner

*Primary Examiner*—Carl S. Miller
(74) *Attorney, Agent, or Firm*—Oblon, Spivak, McClelland, Maier & Neustadt, P.C.

(57) ABSTRACT

An engine of an outboard motor is covered by an outer casing and comprises a plurality of cylinders arranged vertically, a cylinder head to which the cylinders are mounted and in which a valve moving mechanism comprising a cam shaft is housed, a cylinder block, a crank case joined to the cylinder block, a crank shaft disposed vertically at the joining portion between the crank case and the cylinder block, a fuel pump including a plunger and sucking the fuel from a fuel tank through a reciprocal motion of the plunger, a plurality of bearing bosses each disposed between adjacent cylinders, the bearing bosses supporting the cam shaft, a pump driving cam mounted on the cam shaft and adapted to drive the fuel pump, and a driving mechanism disposed between the adjacent cylinders, supported by the bearing bosses and adapted to transfer a rotational motion of the pump driving cam to the plunger to carry out the reciprocal motion thereof.

5 Claims, 6 Drawing Sheets

ENGINE OF OUTBOARD MOTOR

BACKGROUND OF THE INVENTION

The present invention relates to an engine of an outboard motor having an improved structure of a fuel pump arrangement for making compact the engine of the outboard motor.

In known engines of outboard motors, some of the engines are provided with a mechanical fuel pump (mechanically operative fuel pump) which is driven by a reciprocal motion of a plunger. The plunger is usually driven by a pump driving cam mounted on a cam shaft constituting a valve moving mechanism of the engine.

As one example of such prior art, the Japanese Patent Laid-open Publication No. HEI 8-93585 shows a fuel pump arrangement, in which a fuel pump is arranged above a cylinder head at a portion near an intermediate portion, in the longitudinal direction, of the cam shaft and the pump driving cam and the plunger are coupled by means of a rod-shaped driving member.

However, in the structure of the above prior art publication, it is necessary to locate a support member for supporting the driving member in the cylinder head, which results in that the cylinder head is made large in size and complicated in shape, thus being inconvenient.

SUMMARY OF THE INVENTION

An object of the present invention is to substantially eliminate defects or drawbacks encountered in the prior art mentioned above and to provide an engine of an outboard motor comprising:

an engine casing;

a plurality of cylinders arranged vertically in the engine casing;

a cylinder head to which the cylinders are mounted and in which a valve moving mechanism comprising a cam shaft is housed;

a cylinder block disposed in the engine casing;

a crank case joined to the cylinder block;

a crank shaft disposed vertically at the joining portion between the crank case and the cylinder block;

a fuel pump provided with a plunger and sucking a fuel from a fuel tank through a reciprocal motion of the plunger;

a plurality of bearing bosses each disposed between adjacent cylinders, the bearing bosses supporting the cam shaft;

a pump driving cam mounted on the cam shaft and adapted to drive the fuel pump; and a driving mechanism disposed between the adjacent cylinders, supported by the bearing bosses and adapted to transfer a rotational motion of the pump driving cam to the plunger so as to perform a reciprocal motion thereof.

In a preferred embodiment, the bearing bosses are integrally formed with the cylinder head. Each of the bosses is composed of a cylindrical member having an inner hollow portion. The cam shaft is provided with a plurality of bearing journals each disposed between the adjacent cylinders, the pump driving cam is disposed adjacent the bearing journal, and the bearing journal and the pump driving cam are accommodated and supported in the bearing boss.

The pump driving cam and the driving mechanism are disposed in the vicinity of a vertically intermediate portion of the engine in an operative state thereof.

According to the present invention of the structures mentioned above, the pump driving cam for driving the fuel pump is disposed between the cam rows of the adjoining cylinders (first and second cylinders in the described embodiment) and the pump rod for the fuel pump is supported by the one of the bearing boss in which the pump driving cam is housed. Accordingly, it is not necessary to specifically locate any support member for the driving member which has been required in the conventional structure. As a result, it is also not necessary to set a space in the cylinder head for locating the support member, thus making compact the cylinder head and making simple the shape thereof, which contributes to the manufacturing cost reduction.

Furthermore, the bearing bosses for accommodating the bearing journals are also formed, as well as the pump driving cam, to the cylinder head, so that the number of the constructional elements or members can be eliminated.

Still furthermore, since the pump driving cam is disposed in adjacent to the bearing journal and is accommodated in the bearing boss together with the bearing journal, the lubrication oil lubricating the sliding surface between the bearing journal and the bearing boss can also lubricate the sliding surface between the pump driving cam and the pump rod.

Still furthermore, the pump driving cam is disposed between the cam rows of the adjoining cylinders, so that the fuel pump can be arranged to a portion near the vertically intermediate portion of the engine, i.e. cylinder head. As a result, the height difference in locations between the fuel pump and the intake device such as carburetor is reduced (there is less difference in location levels therebetween), so that the fuel pump having relatively low pumping ability can be utilized.

The nature and further characteristic features of the present invention will be made more clear from the following descriptions mentioned with reference to the accompanying drawings.

DESCRIPTION OF THE PREFERRED EMBODIMENT

One preferred embodiment of the present invention will be described hereunder with reference to the accompanying drawings.

Figure 1:
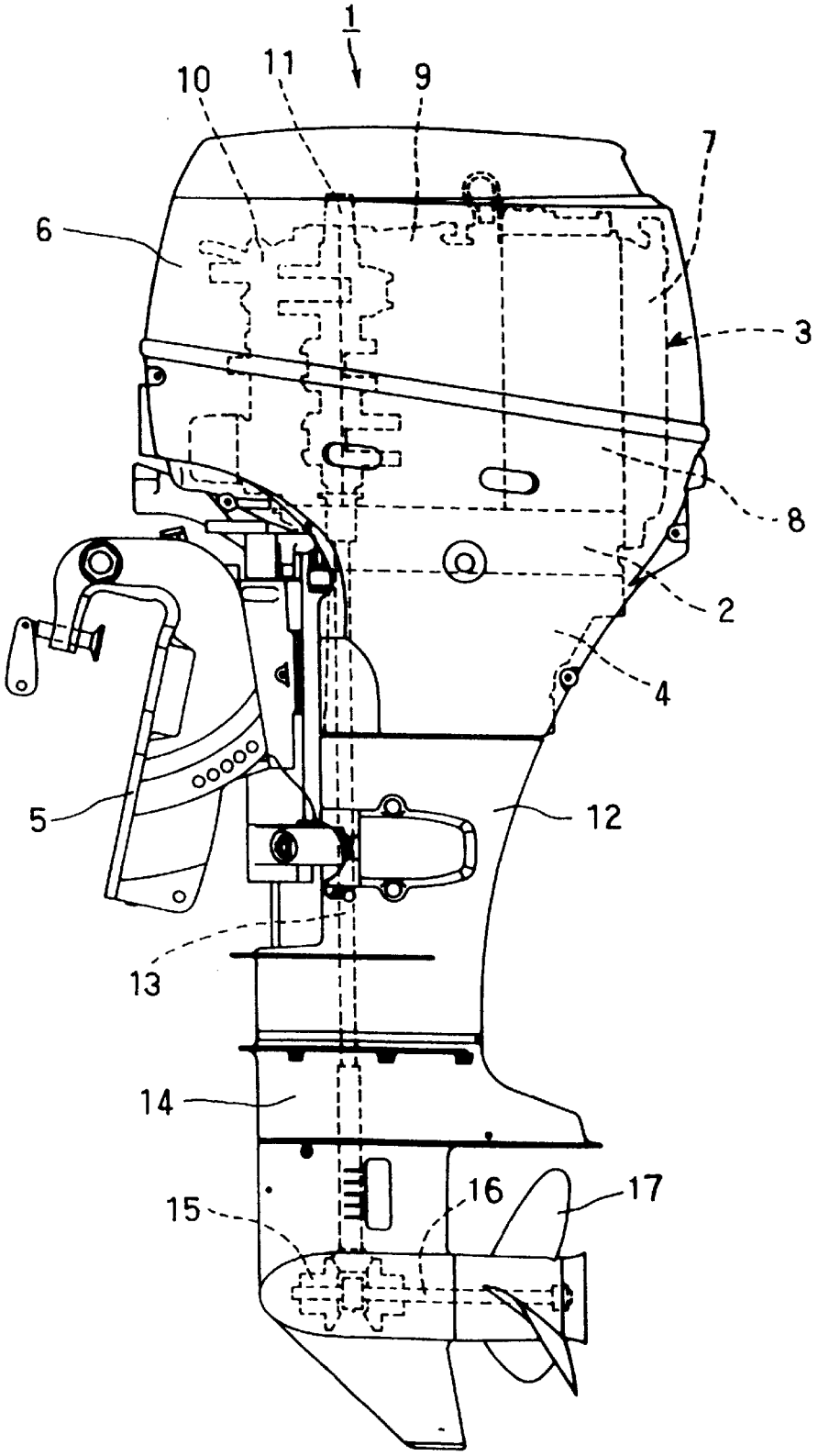
FIG. 1 is a left side view of an outboard motor including an engine provided with a fuel pump of an arrangement according to one embodiment of the present invention.

First, with reference to FIG. 1, showing a left-side view of an outboard motor 1 equipped with an engine holder 2 above which an engine or engine unit 3 is disposed. An oil pan 4 is disposed to the lower portion of the engine holder 2 and a bracket 5 is mounted thereto, through which an outboard motor 1 is mounted to the transom of a hull, not shown. The engine 3 is surrounded by an outboard motor cover 6.

Figure 2:
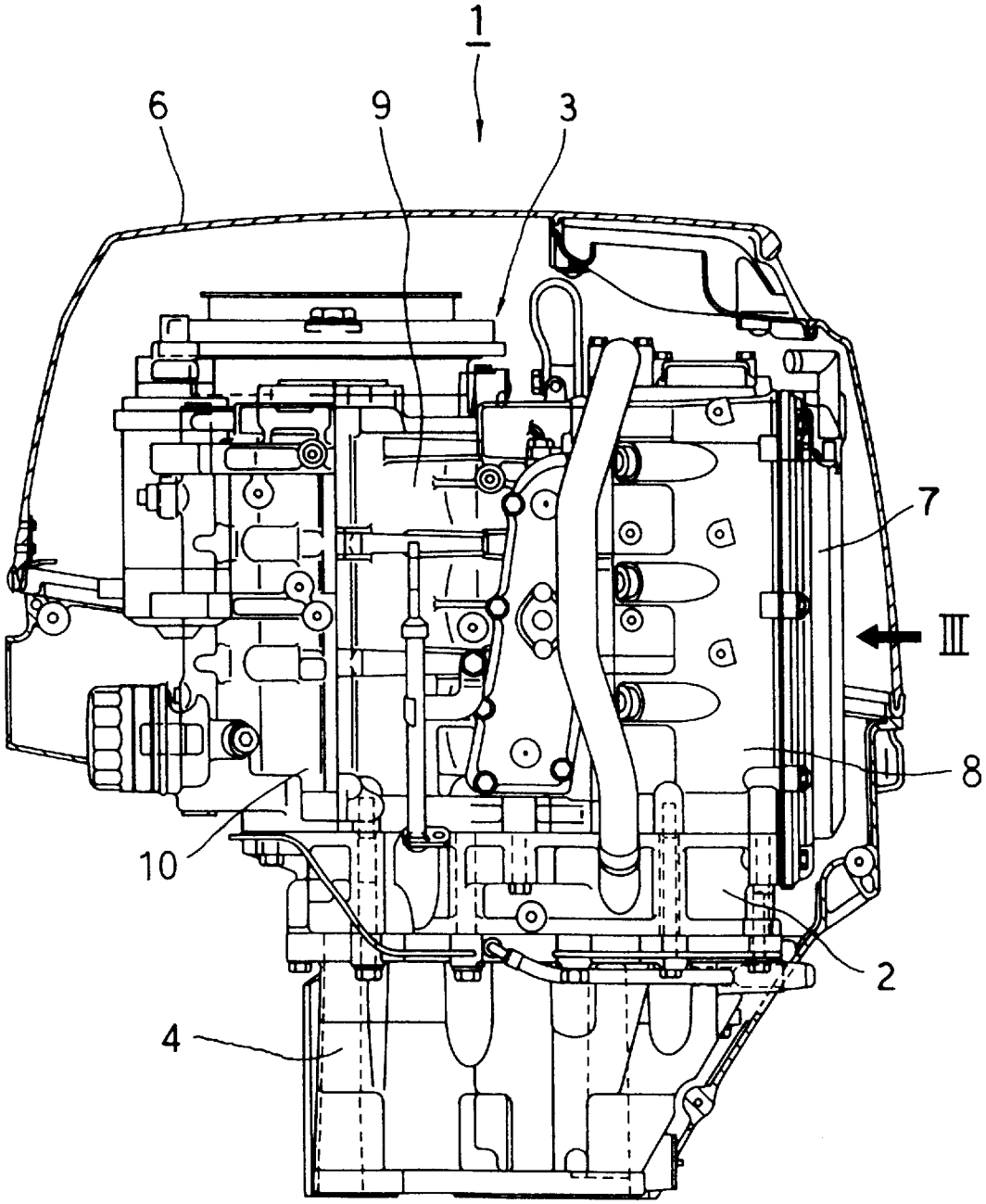
FIG. 2 is a side view, in an enlarged scale, of the engine of the outboard motor of FIG. 1.

Next, with reference to FIG. 2, the engine 3 of the outboard motor 1 is shown in an enlarged scale, in which only the outboard motor cover 6 (engine casing) is shown as cross sectional view. The engine unit 3 mounted to the outboard motor 1 is, for example, a water-cooled four-stroke-cycle three-cylinder engine, and is composed of a cylinder cover 7, a cylinder head 8, a cylinder block 9, crank case 10, in which the respective cylinders are disposed vertically. Further, it is to be noted that, in the present invention, for the sake of convenience, the upper most cylinder will be referred to hereunder as a first cylinder, next lower one as a second cylinder and the further lower one as a third cylinder in a state that the outboard motor 1 is mounted to a hull, for example.

The cylinder block 9 is arranged to a portion at a rear side of the crank case 10 disposed at the most forward portion, left-side as viewed in FIG. 2, of the engine 3. The cylinder head 8 is formed with a rear opening covered by the cylinder head cover 7. The engine 3 of this type is a vertical-type engine in which a crank shaft 11 is substantially perpendicularly arranged at a mating portion of the crank case 10 and the cylinder block 9 (see FIG. 1).

Referring to FIG. 1, a drive shaft housing 12 is disposed below the oil pan 4 mounted to the lower portion of the engine holder 2. An upper end of a drive shaft 13 is coupled to the lower end of the crank shaft 11 through a spline coupling, for example, and the drive shaft 13 extends downward therefrom inside the drive shaft housing 12. The lower end of the drive shaft 13 is engaged with a bevel gear 15 arranged in a gear case 14 disposed below the drive shaft housing 12 so as to drive a propeller 17 of the outboard motor 1 through a propeller shaft 16.

Figure 3:
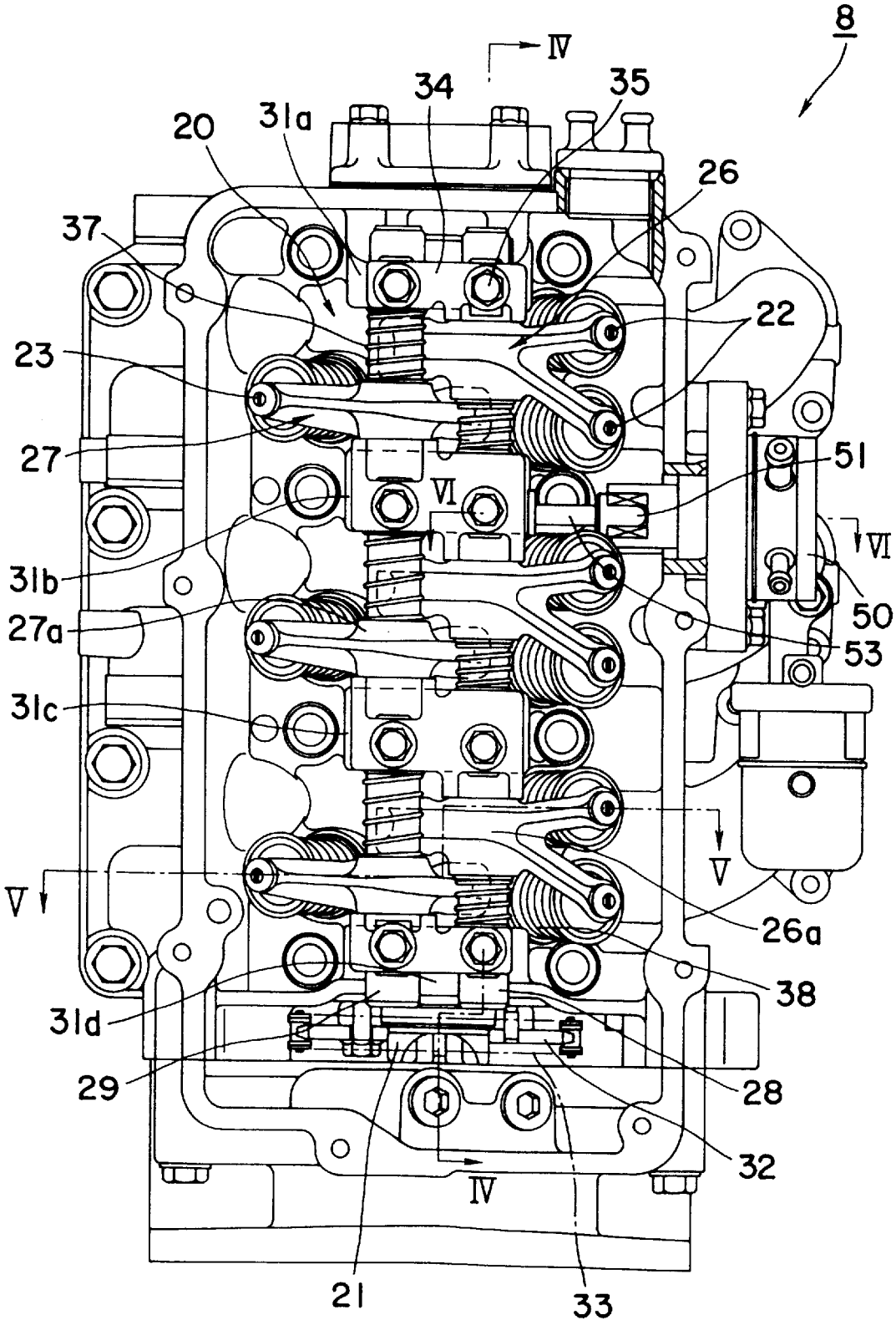
FIG. 3 is a view as viewed from an arrowed direction III in FIG. 2.
Figure 4:
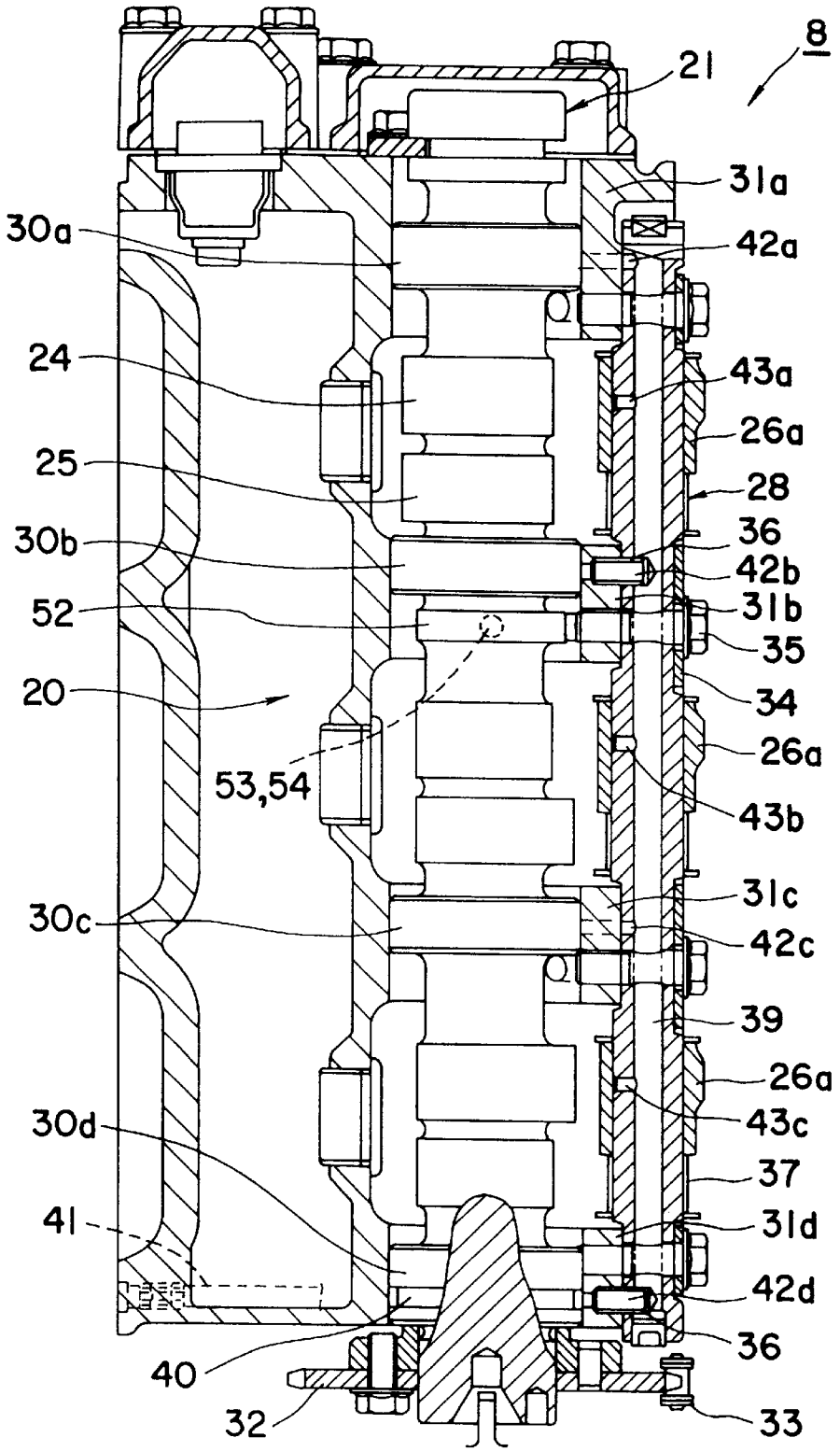
FIG. 4 is a sectional view taken along the line IV—IV in FIG. 3.
Figure 5:
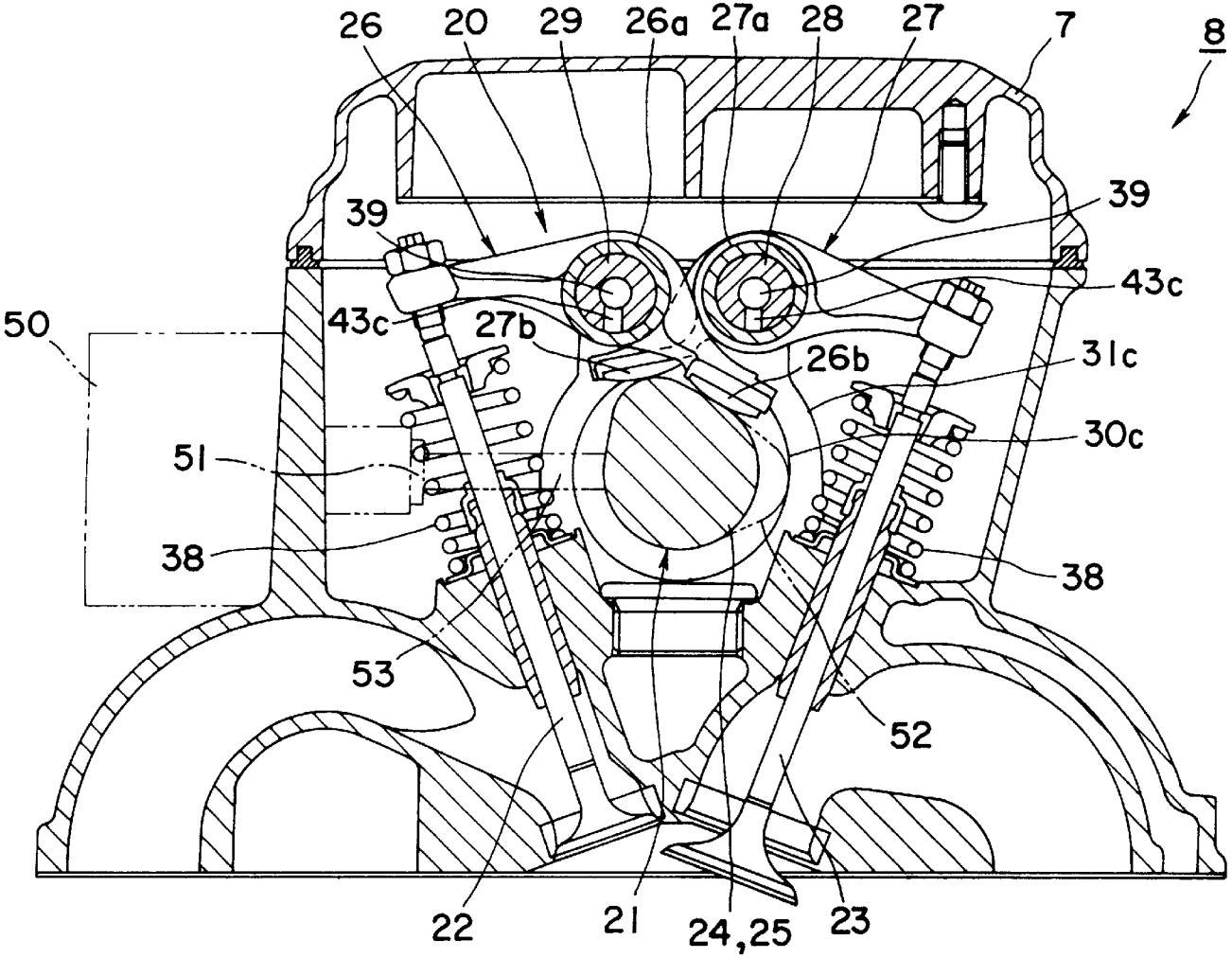
FIG. 5 is a sectional view taken along the line V—V in FIG. 3.

With reference to FIGS. 3 to 5, a valve moving mechanism 20 is arranged inside the cylinder head 8 of the engine 3. The valve moving mechanism 20 is mainly provided with intake valves 22, an exhaust valve 23, air-inlet (intake) cam 24 and exhaust cam 25 which are mounted on the cam shaft 21 for driving the valve, intake and exhaust rocker arms 26 and 27 for transmitting the rotational motions of the air-inlet and exhaust cams 24 and 25 to the intake and exhaust valves 22 and 23, and intake and exhaust rocker shafts 28 and 29 for rotatably supporting the rocker arms 26 and 27.

The valve moving mechanism 20 of the engine 3 of the present embodiment is provided with, for each cylinder, two intake valves 22 and one exhaust valve 23, and a cam row comprising the air-inlet cam 24 and the exhaust cam 25, corresponding to the intake valves 22 and exhaust valve 23, is mounted on the cam shaft 21 for each of the first to third cylinders. Further, in the present embodiment, two intake valves 22, 22 are operated to be opened or closed by one intake rocker arm 26.

Bearing journals 30*a* to 30*d* are formed to the cam shaft 21 to both end portions thereof, at a portion between the cam rows of the first and second cylinders and at a portion between the cam rows of the second and third cylinders. These bearing journals 30*a* to 30*d* are supported to be rotatable by cylindrical bearing bosses 31*a* to 31*d*, respectively, having inner hollow portions and integrally formed to the cylinder head 8 at positions corresponding to the respective bearing journals 30*a* to 30*d*, that is, portions between the respective adjacent cylinders and upper and lower end portions of the cylinder head 8, as viewed in FIG. 3, for example. Further, a cam driven gear 32 is disposed to the lower end portion of the cam shaft 21 and the rotational motion of the crank shaft 11 is transmitted through a timing chain 33.

The respective rocker shafts 28 and 29 are mounted on the bearing bosses 31*a* to 31*d* and fixed thereto by means of bolts 35 or like through brackets 34. In this fixing operation, the rocker shafts 28 and 29 are positioned on, for example, the bearing boss 31*b* between the first and second cylinders and the bearing boss 31*d* below the third cylinder, by using hollow knock pins 36. The rocker arms 26 and 27 have support portions 26*a* and 27*a*, respectively, which are supported to be rotatable by the rocker shafts 28 and 29, and furthermore, springs 37 acting as spacers are disposed between the brackets 34 for fixing the rocker shafts and the support portions 26*a* and 27*a* of the rocker arms thereby to position the rocker arms 26 and 27 on the rocker shafts 28 and 29.

One ends of the rocker arms 26 and 27 abut against the head top portions of the respective valves 22 and 23, and during the rotational motion of the cam shaft 21, cam follower surfaces 26*b* and 27*b* formed to other ends of the rocker arms 26 and 27 are pushed upward by the inlet cam 24 and exhaust cam 25 thereby to open or close the valves 22 and 23, respectively, which are usually closed by the valve springs 38.

An oil gallery 39 is formed to an inside portion of each of the rocker shafts 28 and 29 so as to extend in an axial direction thereof. Further, an oil groove 40 is formed to an outer peripheral surface in a circumferential direction of the bearing journal 30d formed to the lower end portion of the cam shaft 21 and an oil introducing passage 41, which is opened to the oil groove 40, is also formed to an inner peripheral surface of the bearing boss 31*d* supporting the bearing journal 30*d*, and when an oil pump, not shown, is operated, a lubrication oil is guided into the oil groove 40 through the oil introducing passage 41.

The bearing boss 31*d* formed below the third cylinder is formed with a hole for the knock pin 36, which is opened towards the inner peripheral surface of the bearing boss 31*d* opposing to the oil groove 40, and the hollow knock pins 36 constitute oil passages 42*d* so as to guide the lubrication oil introduced to the oil grooves 40 into the oil galleries 39 formed to the rocker shafts 28 and 29. Oil passages 42*a* to 42*c* are formed towards the inner peripheral surfaces of the other bearing bosses 31*a* to 31*c* from the oil galleries 39 thereby to lubricate the sliding surfaces of the bearing bosses 31*a* to 31*d* and the bearing journals 30*a* to 30*d*, respectively. Further, the oil passage 42*b* formed to the bearing boss 31*b* between the first and second cylinders also acts as a hole for the knock pin 36 similar to the oil passage 42*b* for the bearing boss 31*d* formed below the third cylinder. Furthermore, oil passages 43*a* to 43*c* are formed towards the sliding surfaces of the support portions 26*a* and 27*a* of the rocker arms 26 and 27 from the oil galleries 39.

The engine 3 of the outboard motor 1 of the structure mentioned above is equipped with a mechanical fuel pump 50, which operates to suck up the fuel in a fuel tank by the reciprocal motion of the plunger 51 and then to transfer the fuel to an intake device such as carburetor, not shown. Such fuel pump 50 is disposed, for example, to a side surface of the cylinder head 8 (on the intake valve 22 side as in the illustrated embodiment).

A pump driving cam 52 for driving the fuel pump 50 is mounted on the cam shaft 21, and the fuel pump 50 is arranged on the side of the pump driving cam 52 so that the moving and retired direction (reciprocal motion direction) of the plunger 51 is normal to the axis of the cam shaft 21. A pump rod 53 as a fuel pump driving member is disposed between the pump driving cam 52 and the plunger 51 so as to transfer the rotational motion of the pump driving cam 52 to the plunger 51 thereby to move forward and backward the plunger 51.

Figure 6:
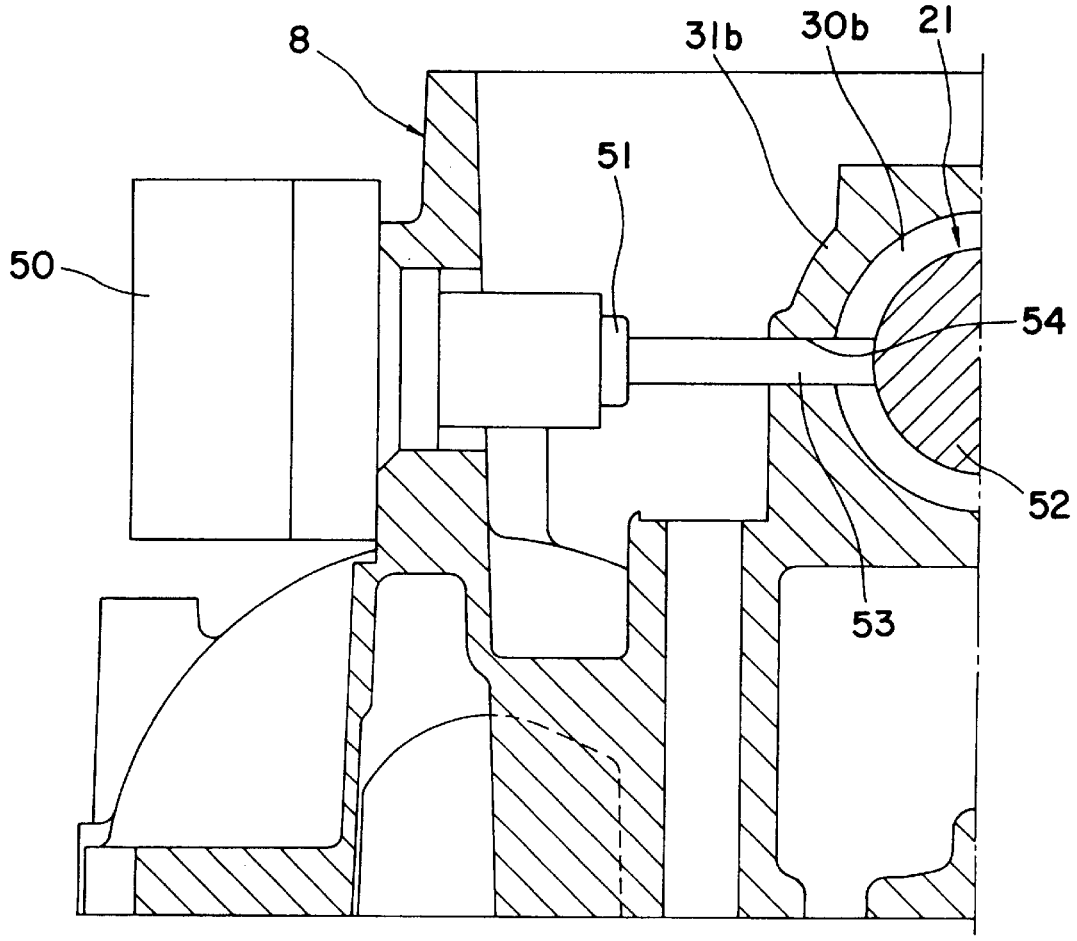
FIG. 6 is a sectional view taken along the line VI—VI in FIG. 3.

The pump driving cam 52 is arranged in adjacent to the bearing journal 30*b* disposed between the cam rows of the adjoining cylinders in the vicinity of the vertically intermediate portion of the cam shaft 21, i.e. the cam rows of the first and second cylinders in the present embodiment, and is accommodated in the bearing boss 31*b* together with the bearing journal 30*b*. Furthermore, a support hole 54 for the pump rod 53 is formed to the bearing boss 31*b* so as to slidably support the pump rod 53 to a predetermined position as shown in FIG. 6.

The described embodiment of the present invention will attain the following functions and effects.

The pump driving cam 52 for driving the fuel pump 50 is disposed between the cam rows of the adjoining cylinders (first and second cylinders in the described embodiment) and the pump rod 53 as the driving member for the fuel pump 50 is supported by the bearing boss 31*b* in which the pump driving cam 52 is housed. Accordingly, it is not necessary to specifically locate a support member for the driving member which has been required in the conventional structure. As a result, it is also not necessary to define a space in the cylinder head 8 for locating the support member, thus making compact the cylinder head 8 and making simple the shape thereof, contributing to the manufacturing cost reduction.

The bearing bosses 31*a* to 31*d* for accommodating the bearing journals 30*a* to 30*d* are also formed, as well as the pump driving cam 52, to the cylinder head 8, so that the number of the constructional elements or members can be eliminated.

Still furthermore, since the pump driving cam 52 is disposed in adjacent to the bearing journal 30*b* and is accommodated in the bearing boss 31*b* together with the bearing journal 30*b*, the lubrication oil lubricating the sliding surface between the bearing journal 30*b* and the bearing boss 31*b* can also lubricate the sliding surface between the pump driving cam 52 and the pump rod 53.

Still furthermore, the pump driving cam 52 is disposed between the cam rows of the adjoining cylinders, so that the fuel pump 50 can be arranged to a portion near the vertically intermediate portion of the engine 3, i.e. cylinder head 8 in the described embodiment. As a result, the height difference in locations between the fuel pump and the intake device such as carburetor is reduced (there is less difference in location levels therebetween), so that the fuel pump 50 having relatively low pumping ability can be utilized.

It is to be noted that the present invention is not limited to the described embodiment and many other changes and modifications may be made without departing from the scopes of the appended claims.

What is claimed is:

1. An engine of an outboard motor comprising:

an outer casing;

a plurality of cylinders arranged vertically in the outer casing;

a cylinder head to which the cylinders are mounted and in which a valve moving mechanism including a cam shaft is housed;

a cylinder block disposed in the outer casing;

a crank case joined to the cylinder block;

a crank shaft disposed vertically at the joining portion between the crank case and the cylinder block;

a fuel pump being provided with a plunger and sucking a fuel from a fuel tank through a reciprocal motion of the plunger;

a plurality of bearing bosses each disposed between adjacent cylinders, said bearing bosses supporting the cam shaft; and a pump driving cam mounted on the cam shaft and adapted to drive the fuel pump;

wherein a drive being supported by the bearing bosses is disposed between the adjacent cylinders and is adapted to transfer a rotational motion of the pump driving cam to the plunger so as to carry out a reciprocal motion thereof.

2. An engine of an outboard motor according to claim 1, wherein said bearing bosses are integrally formed with the cylinder head.

3. An engine of an outboard motor according to claim 1, wherein each of said bearing bosses is composed of a cylindrical member having an inner hollow portion.

4. An engine of an outboard motor according to claim 3, wherein said cam shaft is provided with a plurality of bearing journals each disposed between the adjacent cylinders, said pump driving cam is disposed adjacent the bearing journal, and said bearing journal and said pump driving cam are accommodated and supported in the bearing boss.

5. An engine of an outboard motor according to claim 1, wherein said pump driving cam and said drive are disposed in a vicinity of a vertically intermediate portion of the engine in an operative state thereof.

* * * * *

UNITED STATES PATENT AND TRADEMARK OFFICE

CERTIFICATE OF CORRECTION

PATENT NO. : 6,354,278 B1
DATED : March 12, 2002
INVENTOR(S) : Kawasaki

It is certified that error appears in the above-identified patent and that said Letters Patent is hereby corrected as shown below:

Title page,
Item [30], the Foreign Application Priority Data is incorrect. It should read as follows:

-- [30] Foreign Application Priority Data

March 30, 1999 (JP) ..... 11-090215 --

Signed and Sealed this

Seventeenth Day of September, 2002

*Attest:*

*Attesting Officer*

JAMES E. ROGAN
*Director of the United States Patent and Trademark Office*